US006502495B1

(12) United States Patent
Beary

(10) Patent No.: US 6,502,495 B1
(45) Date of Patent: Jan. 7, 2003

(54) ROTARY MAGAZINE FOR FIREARM WITH HOLD-OPEN LEVER

(76) Inventor: Joseph Alfred Beary, 10 Jefferson Pl., Port Hadlock, WA (US) 98339

( * ) Notice: Subject to any disclaimer, the term of this patent is extended or adjusted under 35 U.S.C. 154(b) by 0 days.

(21) Appl. No.: 09/691,730

(22) Filed: Oct. 18, 2000

(51) Int. Cl.[7] ..... F41A 9/74
(52) U.S. Cl. ..... 89/34; 89/33.17
(58) Field of Search ..... 89/33.02, 33.17, 89/33.25, 33.16, 34

(56) References Cited

U.S. PATENT DOCUMENTS

| | | | | | |
|---|---|---|---|---|---|
| 2,113,793 | A | * | 4/1938 | Larsson et al. | 89/33.02 |
| 2,321,045 | A | | 6/1943 | Roemer | 42/18 |
| 2,341,869 | A | | 2/1944 | Johnson, Jr. | 42/19 |
| 3,846,928 | A | | 11/1974 | Ruger et al. | 42/16 |
| 4,438,678 | A | | 3/1984 | Ruger | 42/25 |
| 4,573,394 | A | * | 3/1986 | Goff et al. | 89/33.02 |
| 4,594,935 | A | | 6/1986 | Smith | 89/176 |
| 4,930,400 | A | * | 6/1990 | Brandl et al. | 89/34 |
| 5,600,083 | A | * | 2/1997 | Bentley et al. | 89/33.02 |
| 6,032,395 | A | * | 3/2000 | Bentley et al. | 42/19 |

FOREIGN PATENT DOCUMENTS

| | | | | |
|---|---|---|---|---|
| GB | 539414 | * | 9/1941 | 89/33.02 |
| GB | 628734 | * | 9/1949 | 89/33.02 |

OTHER PUBLICATIONS

National Rifle Association, *Firearms Assembly I, The NRA Guidebook to Shoulder Arms*, pp. 144–145 (1972).

* cited by examiner

*Primary Examiner*—Stephen M. Johnson
(74) *Attorney, Agent, or Firm*—McDonnell Boehnen Hulbert & Berghoff

(57) ABSTRACT

A rotary magazine for a firearm includes a hold-open lever that is actuated after the last shot is fired to hold the bolt in an open condition to signify that the magazine is empty. No modification to the firing mechanism, bolt or other part of the firearm is required. The hold-open lever is tripped to a hold open position by a stud or similar trip mechanism mounted to the magazine's rotor. The rotor and the magazine's feed insert are formed in a manner such that the rotor rotates an additional amount beyond its nominal original position (magazine empty), without interference from the feed insert or other structures in the magazine. When this additional rotation occurs, the trip mechanism on the rotor actuates the lever, moving it to a position in which it blocks the forward movement of the bolt. Several different arrangements for a rotary magazine with the hold open feature are described.

27 Claims, 15 Drawing Sheets

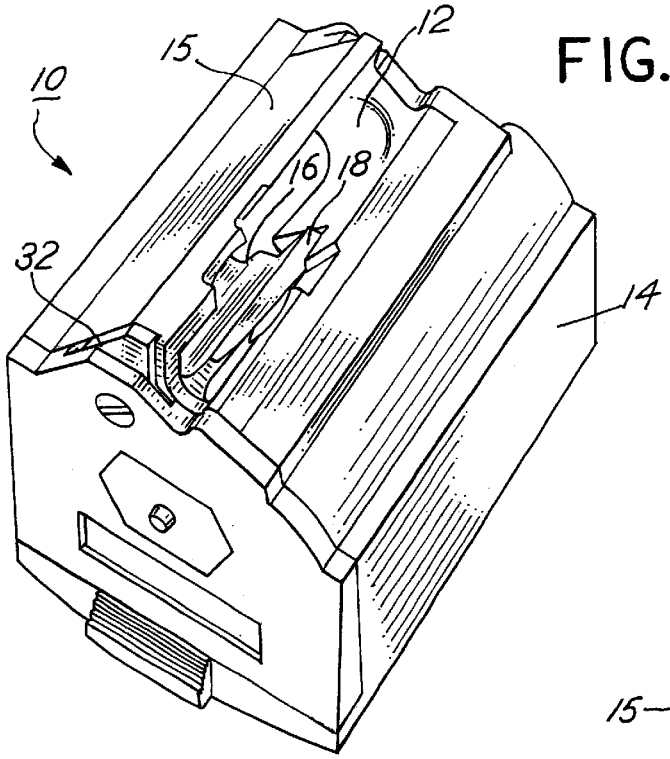
FIG. 4
FIG. 5
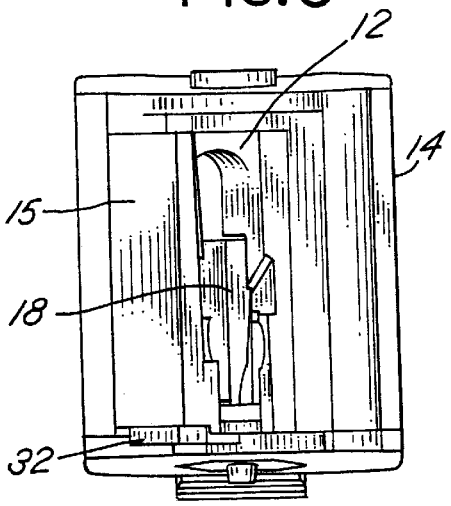
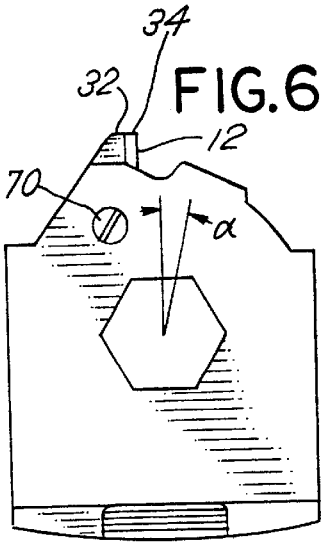
FIG. 6
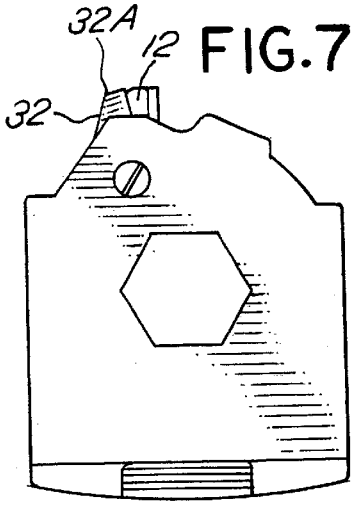
FIG. 7

FIG.54A
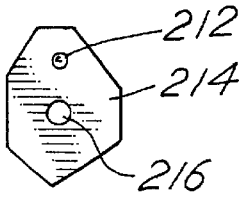
FIG.54B
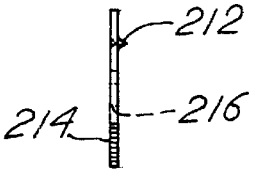
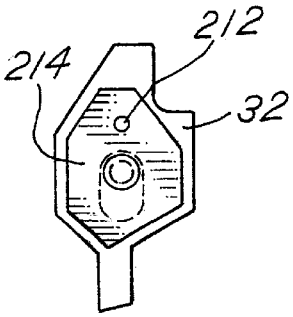
FIG.55
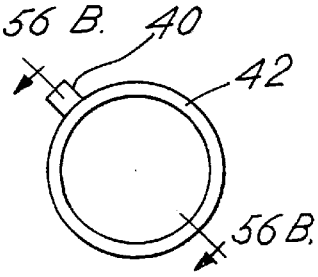
FIG.56A
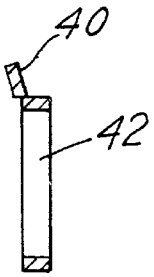
FIG.56B
FIG.57
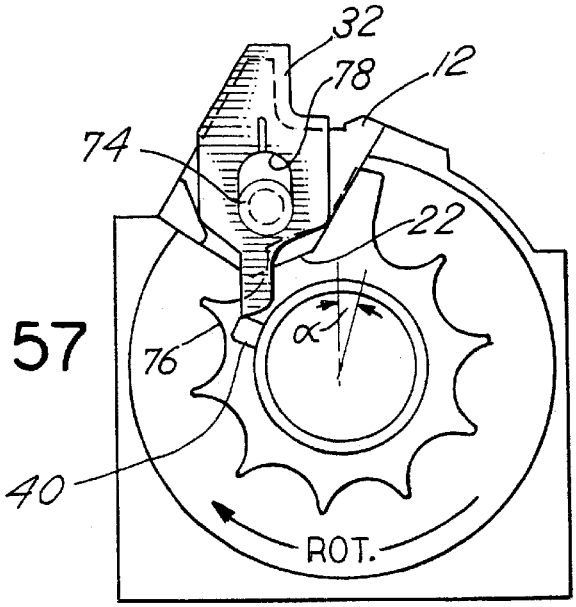

FIG.58
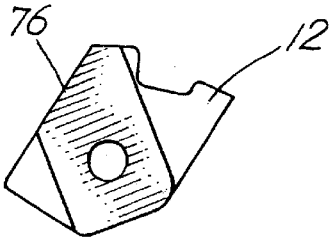
FIG.59
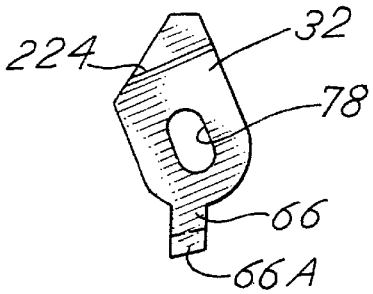
FIG.60A
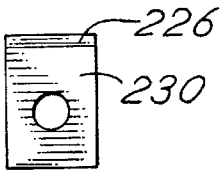
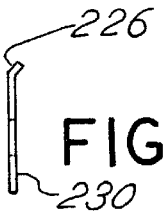
FIG.60B
FIG.61
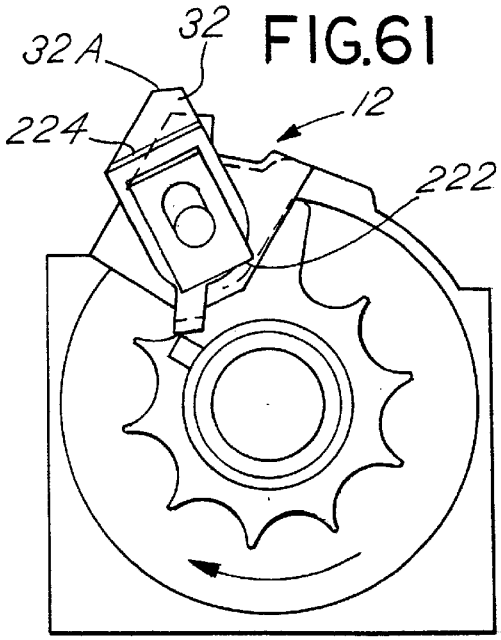
FIG.62A
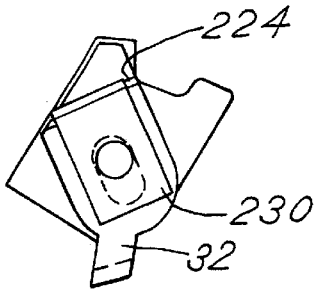
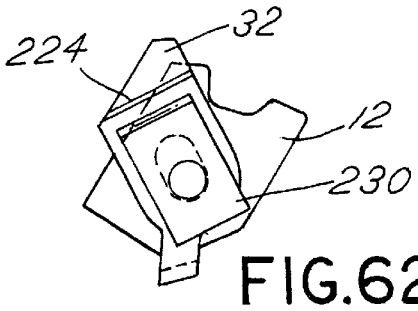
FIG.62B FIG.63A
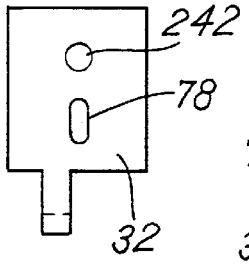
FIG.63B
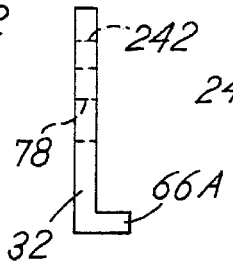
FIG.64A
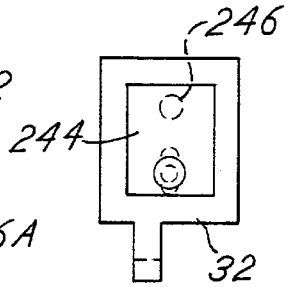
FIG.64B
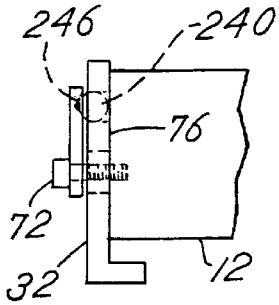
FIG.65
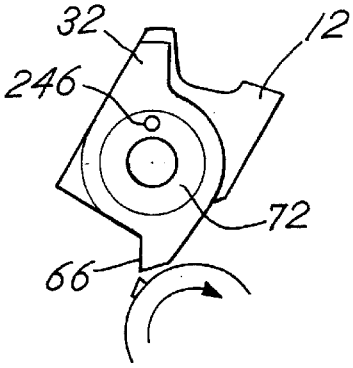
FIG.67
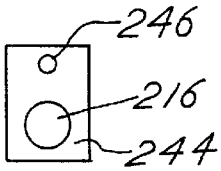
FIG.68
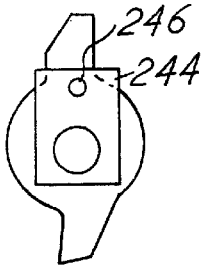
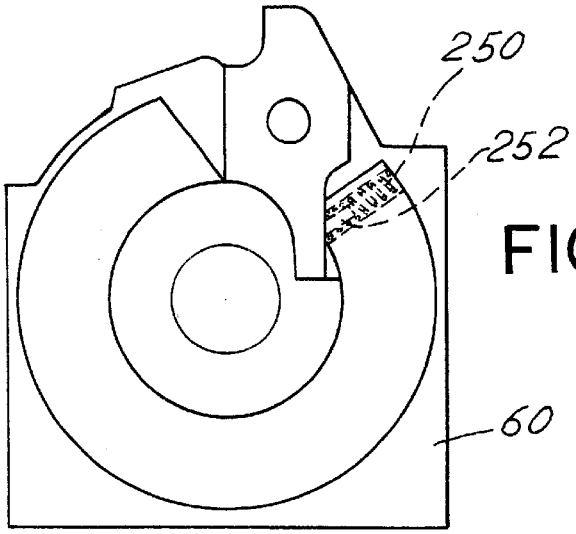
FIG.66

ROTARY MAGAZINE FOR FIREARM WITH HOLD-OPEN LEVER

BACKGROUND OF THE INVENTION

A. Field of the Invention

This invention relates generally to the field of firearms. More particularly, the invention relates to a rotary magazine for a firearm that contains a mechanism for holding the bolt of the firearm in an open position after the last cartridge in the firearm has been fired and the bolt has recoiled, thereby signaling to the user that the magazine is empty. The invention is applicable to bolt-action, manually operated firearms, semi-automatic firearms, and fully automatic firearms.

B. Description of Related Art

It is known in the art to provide a hold-open feature by which the bolt remains in an open position after the last shot in a magazine has been fired. The purpose of the hold-open feature is to alert the user of the need to re-load the weapon, and to avoid an unnecessary and annoying attempted firing of the weapon when in fact the magazine is empty. Representative patents describing hold-open features include Roemer, U.S. Pat. No. 2,321,045; Ruger et al., U.S. Pat. No. 3,846,928, Ruger, U.S. Pat. No. 4,438,678, Smith, U.S. Pat. No. 4,594,935 and Johnson, U.S. Pat. No. 2,341,869.

The Johnson rifle described in the '869 patent is a rotary magazine semi-automatic weapon which saw limited duty in WW II. The Johnson rifle is also described to some extent in the publication Firearms Assembly 1, The NRA Guidebook to Shoulder Arms, pp. 144–145, published in 1972 by the National Rifle Association. The rifle includes a hold-open feature, however the hold open feature is a rather complex arrangement of mechanical parts that involve both on the rifle body and the magazine. As such, the design is not one suited to wide applicability, or suited to the situation in which a magazine is modified to provide the hold open feature and no other modifications are needed to the rest of the firearm.

It is the belief of the present inventor that many, if not most, rotary magazines for semi-automatic firearms do not contain a hold-open feature. One of the most popular of such firearms is the Ruger® 10–22-caliber semi-automatic rifle. Adding a hold-open feature to those firearms with rotary magazines that presently do not have a hold open feature would certainly improve the performance and overall experience in using the firearm. However, the addition of a hold-open feature, in which no modifications are made to the rest of the firearm, is a difficult design in which there certainly is no obvious solution. To see why this is the case, the magazine of Ruger® 10–22-caliber semi-automatic rifle will be briefly described.

Referring now to FIGS. 1–3, the factory or stock rotary magazine 10 for a Ruger® 10–22 semi-automatic rifle is shown isolated from the rest of the firearm. In FIG. 1, the magazine is shown in a perspective view looking down on a feed insert 12 and the magazine housing 14. The feed insert 12 is a metal piece that receives the cartridges when they are inserted into the magazine. The feed insert has a flat planar surface 15 that the bolt slides over when the firearm is fired. A rotor 16 is positioned inside the magazine housing. The rotor 16 has a series of projecting ridge elements circumferentialy spaced about the shaft of the rotor that accommodate or receive the individual cartridges when the cartridges are inserted into the feed insert. A biasing spring (not shown) tends to bias the rotor in a clockwise direction as viewed from the rear of the magazine to move the cartridges to a firing position at the top of the feed insert. When the user inserts the cartridges, the force accompanying insertion the cartridge into the feed insert 12 past overcomes the force of the biasing spring, allowing the rotor 16 to rotate in a counterclockwise direction and receive the individual cartridges between the ridge elements of the rotor. One of the projecting ridges is slightly larger than the rest and is used to move the last cartridge up into firing position; this ridge 18 is shown in FIGS. 1 and 2. The last cartridge is held up in position by the rearmost portion 18A of the ridge 18 by a wedging action. This wedging action also prevents further rotor rotation until the cartridge is pushed forward or removed in the improved magazine of this invention.

The unaltered, factory stock magazine of FIGS. 1–3 holds ten rounds of 0.22 caliber long rifle ammunition. Each of the ten rounds is stripped off the magazine 10 and pushed forward into the rifle chamber and fired until the magazine is empty. The force of the rotor's biasing spring keeps each cartridge in turn jammed up into the feed insert's feed lips 20 in position for firing. The tenth round (last cartridge) relies upon the rearmost portion 18A of the top portion of the ridge 18 to position it between the feed lips 20 in position for firing.

After the last shot is fired, the rotor is stopped from further rotation by interference between the ridge 18 and the feed insert at the location 24 shown in FIGS. 1 and 2. No further rotation is possible due to this mechanical interference. The design of the factory magazine was to intentionally prevent any further rotation to allow ease of loading of the first cartridge, i.e., insure sufficient space between the top of the rotor and the side of the feed insert to allow the first cartridge to be inserted into the magazine.

The magazine of FIGS. 1–3 has no features to hold the rifle bolt open after the last shot has been fired. It is an object of the invention to provide modifications to a rotary magazine of the general type shown in FIG. 1 to provide such a hold-open feature. Another principal feature of this invention is that the hold open feature is completely provided by the magazine, and as such does not require any modifications whatsoever to the firearm per se.

SUMMARY OF THE INVENTION

A rotary magazine is provided for a firearm having a bolt that reciprocates between an open position and a closed, firing position, in which the magazine includes features to hold the bolt in an open position after the last shot has been fired. The hold open features are provided entirely in the magazine, and no modification is needed to the firearm. While the rotary magazine of the present invention is particularly suitable for a semi-automatic firearm, such as the Ruger® 10–22-caliber semi-automatic rifle and magazines of similar design, and while the following text and accompanying figures describe various embodiments of a rotary magazine for that rifle, it will be appreciated that the scope of the invention encompasses other types of firearms having rotary magazines.

The inventive rotary magazine with the hold-open feature includes a magazine housing adapted for containing a plurality of cartridges. A feed insert is carried by the housing and has a planar surface along which the bolt travels when reciprocating between the closed and open positions. A spring-loaded rotor is contained within the housing that has a shaft rotating about an axis. The rotor advances the cartridges one by one to a firing position in the feed insert.

A hold-open lever is positioned within the magazine adjacent to the planar surface of the feed insert. The hold-open lever has a first position in which the lever is in an aligned condition relative to the planar surface of the feed insert, and a second or deployed position in which the lever is in a non-aligned condition relative to the planar surface. In the second position, the lever blocks movement of the bolt from the open position to closed position, holding the bolt open.

The shaft of the rotor carries a trip mechanism. The trip mechanism is provided as a means for moving the lever from the first position to the deployed position after the last shot has been fired. In particular, when the last cartridge is fired and the bolt has recoiled to the rear of the magazine, the rotor is permitted to rotate an additional amount (typically between 10 and 15 degrees), and this additional rotation allows the trip mechanism to contact the hold-open lever and thereby actuate the hold-open lever and cause it to move (e.g., by rotation or linear translation) to the deployed position in which it blocks forward movement of the bolt. Thus, the bolt is held in the open position.

The following specification describes numerous embodiments of the hold-open lever, trip mechanism, rotor, and feed insert which are designed to allow the rotor to rotate an additional amount past its nominal, original position after the last shot has been fired, and thereby allow the trip mechanism to actuate the hold-open lever. In some of the embodiments, the feed insert is provided with a recess or void region to accommodate the rotor to allow such additional rotation. In other embodiments, the rotor is formed with a recess or void so that it does not interfere with the feed insert, permitting the rotor to rotate an additional 10 to 15 degrees after the last shot has been fired.

Additionally, several different configurations of a trip mechanism and hold-open lever are described. In some embodiments, the hold-open lever pivots about a lug formed on the side of the feed insert, and the trip mechanism comprises a small stud attached to the shaft of the rotor. When the rotor rotates that additional 10 to 15 degrees, the stud contacts a portion of the hold-open lever. This contact and associated rotation of the shaft of the rotor causes the hold-open lever to pivot about the lug such that a second portion of the hold-open lever is moved to the blocking position, holding the bolt is the open condition. In yet further embodiments, the hold-open lever is designed such that the action of the trip mechanism causes the hold-open lever to move in a linear fashion. In particular, the hold-open lever is actuated from a depressed position to an extended position. In the extended position, a portion of the hold-open lever is moved into an obstructing position relative to the path of the bolt, holding the bolt in an open condition.

In another aspect, a method is provided of improving (e.g., modifying) a rotary magazine for a firearm such that the magazine provides a hold-open feature. The magazine has a rotor, a feed insert and a magazine housing for containing a plurality of cartridges. The method is particularly suitable for either retrofit modification of an existing magazine (such as the Ruger® 10–22-caliber semi-automatic rifle) or, more preferably, used in the design and manufacturing of new magazines for the firearm.

The method involves forming the rotor and/or feed insert so as to enable the rotor to further rotate relative to the feed insert beyond a nominal original position after the last cartridge in the magazine has been fired and the bolt moves to the rear, with such further rotation occurring without interference or binding between the rotor and feed insert. The method further includes the step of incorporating a hold-open lever into the magazine to block forward motion of the bolt and retain the bolt in an open position. The method further includes the step of providing an actuating mechanism for the hold open lever. Several different types of actuating mechanisms are described herein. The actuating mechanism is responsive to the further rotation of the rotor relative to the feed insert to thereby move the hold-open lever into a position to block the forward motion of the bolt after the last cartridge in the magazine has been fired and the bolt moves to the rear.

As described in detail herein, the rotor and/or feed insert can be formed in a manner in which voids or recessed regions are formed so as to allow the additional rotation past the nominal original position to occur. In a preferred embodiment, a portion of the feed insert is removed. The feed insert includes a pair of feed lips or cartridge aligning features to maintain proper alignment of the cartridge with respect to the feed insert. However the preferred modification to the feed insert leaves such aligning features intact.

These and many other details of presently preferred and alternative embodiments will be more apparent from the following detailed description and the appended drawings.

BRIEF DESCRIPTION OF THE DRAWINGS

Presently preferred and alternative embodiments of the invention will be discussed below in conjunction with the appended drawing figures, wherein like reference numerals refer to like elements in the various views, and wherein:

FIG. 4 is a perspective view of a rotary magazine similar to that of FIG. 1 in accordance with the present invention in which the magazine provides a hold-open feature to block the forward travel of the rifle bolt when the last shot is fired and the bolt moves to the rear;

FIG. 5 is a top view of the magazine of FIG. 4;

FIG. 6 is an end view of the magazine of FIG. 4, with the hold-open lever in an aligned condition with the feed insert;

FIG. 7 is an end view of the magazine of FIG. 4 with the hold-open lever in its obstructing position;

FIGS. 54A and 54B are two views of a spring retainer for the hold open lever of FIGS. 50A and 50B which is designed to hold the hold-open lever in the rest or non-deployed position prior to the firing of the last cartridge in the magazine;

FIG. 55 is a plan view of the assembly of the hold open lever of FIG. 50A and the spring retainer of FIG. 54A;

FIGS. 56A and 56B are two views of a trip mechanism fastened to the shaft of the rotor of FIG. 4A which actuates the hold open lever construction of FIG. 55;

FIG. 57 is an end view of the rotor and magazine of FIG. 4A with the cover plate removed, showing the action of the trip mechanism of FIGS. 56A and 56B to move the hold open lever relative to the feed insert when the rotor has rotated the amount indicated by angle $\alpha$;

FIG. 58 is an end view of the feed insert similar to that of FIG. 52, except that the milled away portion is given a slightly different configuration to accommodate an alternative design of the hold open lever, shown in FIG. 59;

FIG. 59 is an alternative embodiment of a hold-open lever;

FIGS. 60A and 60B are two views of a spring retainer for use with the hold open lever of FIG. 59 to retain the hold-open lever in the rest (non-deployed position);

FIG. 61 is another end view of the magazine similar to FIG. 57, showing the actuation of the hold open lever of FIG. 59;

FIGS. 62A and 62B are two views of the assembled hold-open lever and spring retainer of FIGS. 59 and 60, respectively, in the rest and deployed positions relative to the feed insert of FIG. 58;

FIGS. 63A and 63B are two views of another embodiment of the hold open lever, showing a hole in the lever for receiving a ball bearing riding on the feed insert;

FIG. 64A is plan view of the hold open lever of FIG. 63 with a spring retainer having a small hole for capturing the top of the ball bearing;

FIG. 64B is a side view of a feed insert, hold open lever of the design shown in FIG. 63, and spring retainer shown in FIG. 64A;

FIG. 65 is an elevational view of an alternative embodiment of the hold open lever of FIG. 4 and 4A;

FIG. 66 is an elevational view of an alternative embodiment of the end plate of FIG. 14, showing a plunger and spring designed to hold the hold-open lever in the rest or non-deployed position;

FIG. 67 is a plan view of the spring retainer of FIG. 64A;

FIG. 68 is a plan view of the spring retainer of FIG. 67 and another alternative embodiment of the hold-open lever of FIG. 4A.

DETAILED DESCRIPTION OF THE PREFERRED AND ALTERNATIVE EMBODIMENTS

In accordance with the invention, a rotary magazine for a firearm is provided with a hold-open feature. The hold open feature does not require any modifications to the rest of the firearm. Several different preferred and alternative embodiments will be described in detail below in detail.

Figure 42:
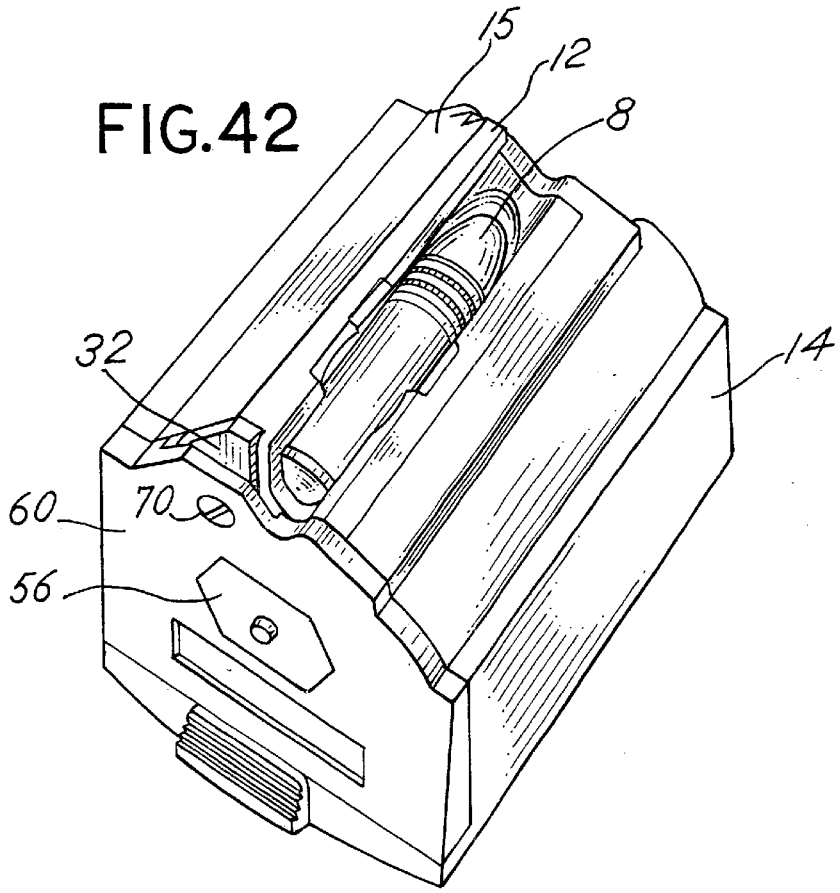
FIG. 42 is a perspective view of the magazine of FIG. 4 loaded with cartridges.
Figure 43:
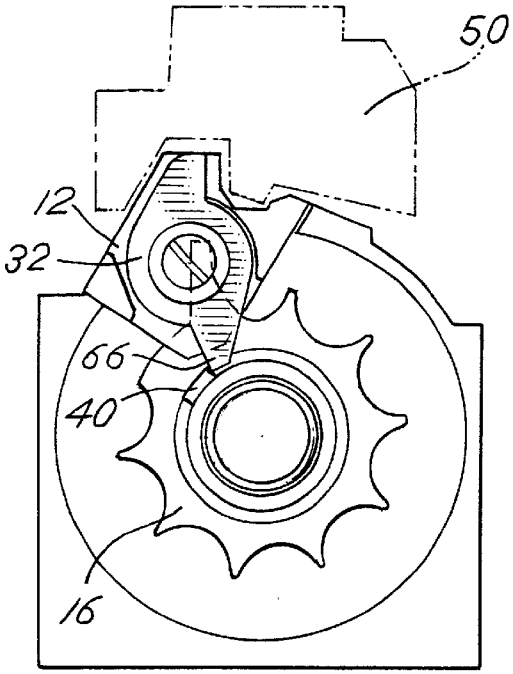
FIG. 43 is an end view of the magazine of FIG. 4, with the end plate removed, showing the position of the rotor and hold-open lever immediately prior to the last shot being fired, with the rifle bolt shown in phantom.
Figure 44:
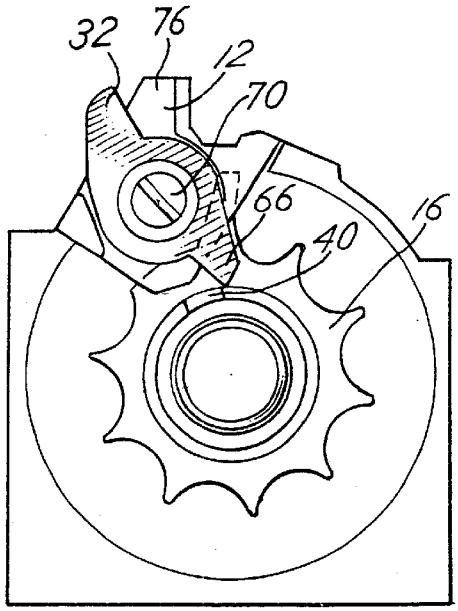
FIG. 44 is an end view of the magazine of FIG. 4 showing the additional rotation of the rotor causing the trip stud to move the hold-open lever to the obstructing position as shown in FIG. 7.

Referring to FIGS. 4, 4A and 4B, and 42, the magazine includes a magazine housing 14 adapted for containing a plurality of cartridges 8 shown in FIG. 42. A feed insert 12 is carried by the housing 14 having a planar surface 15 along which the bolt travels when reciprocating between closed and open positions. A rotor 16 contained within the housing 14 has a shaft 26 rotating about an axis 28. The rotor advances cartridges 8 one by one to a firing position in magazine, i.e., in the feed insert 12 as shown in FIG. 42, due to urging of a biasing spring 30 which is further wound when the magazine is loaded with cartridges. A fastener 31 (FIG. 4A) with a head 31A and threaded tip 31B holds the entire assembly together, with the head 31A received in the aperture 14A of the housing 14 and tip 31B threadably engaging the hex end cap 56.

Figures 4A, 4C:
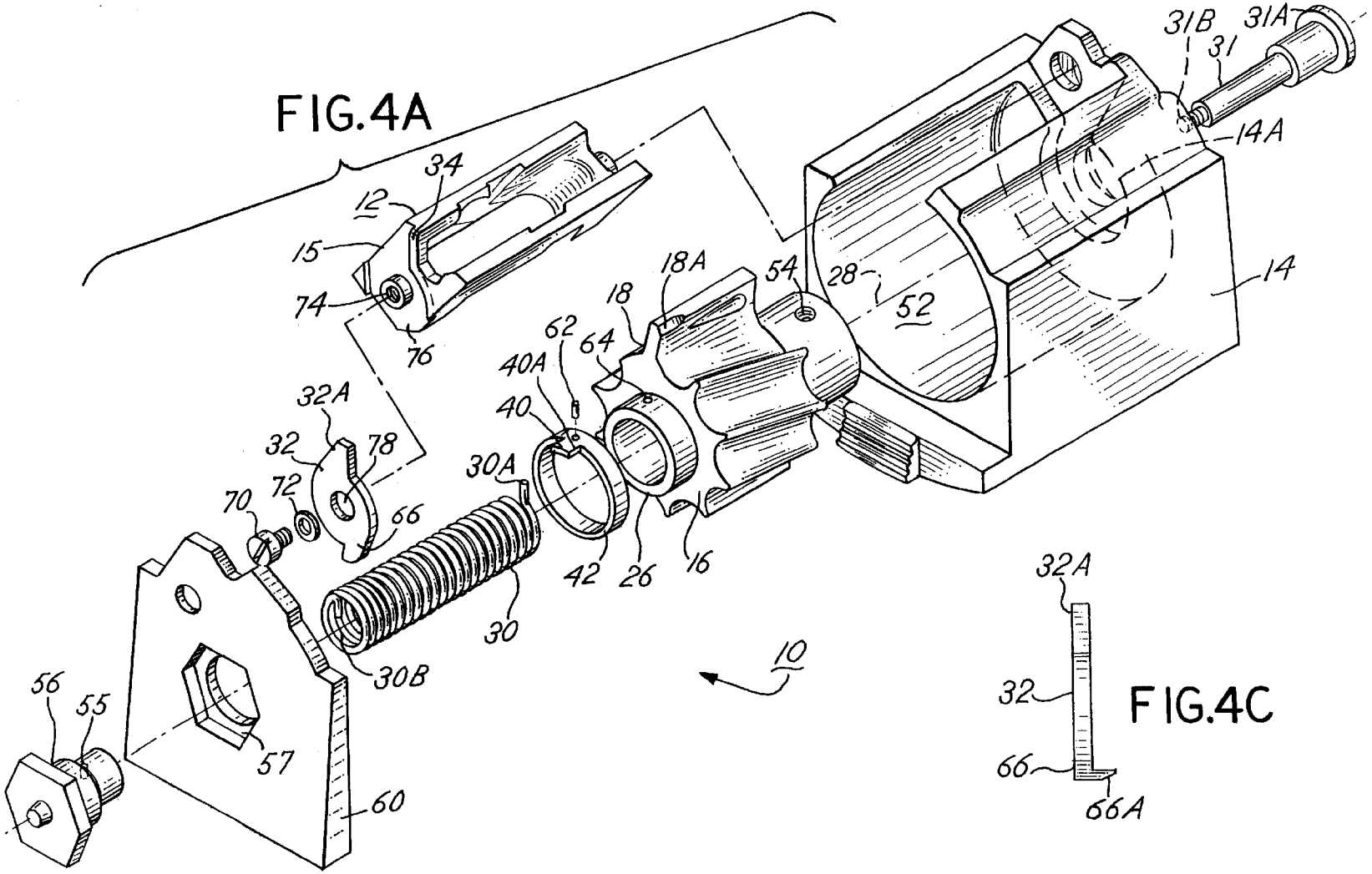
FIG. 4A is an exploded view of the magazine of FIG. 4.
FIG. 4C is a side view of the hold open lever of FIG. 4A.
Figure 4B:
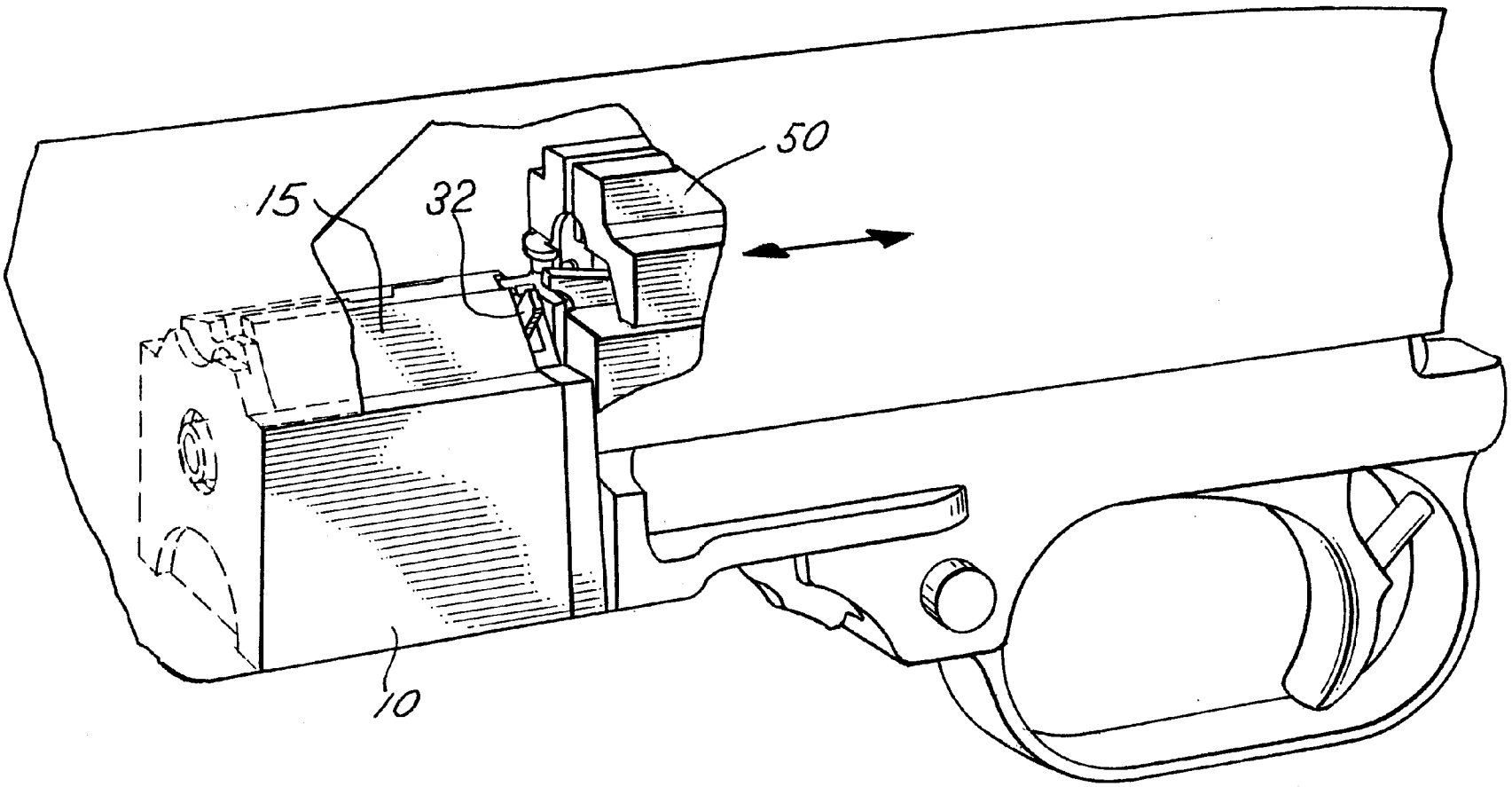
FIG. 4B is a perspective view of the magazine of FIG. 4 installed in the Ruger® 22-caliber semi-automatic rifle, showing the position of a hold-open lever to block forward movement of the rifle bolt after the last shot is fired.

The magazine 10 includes a hold-open lever 32. The hold-open lever 32 is moveable between a first or rest position (shown in FIG. 6) in which the lever is in an aligned condition relative to the shoulder 34 of the feed insert and the surface 15, and a second or deployed position (shown in FIGS. 7 and 4B) in which the lever 32 is in a non-aligned condition relative to the feed insert. When the lever is in the deployed position, the extreme peripheral portion 32A of the hold open lever is in the forward path of the rifle bolt 50 and thereby blocks further movement of the bolt past the lever 32 and holds it open as the bolt tries to return to the battery condition, as indicated in FIG. 4B.

Figure 9:
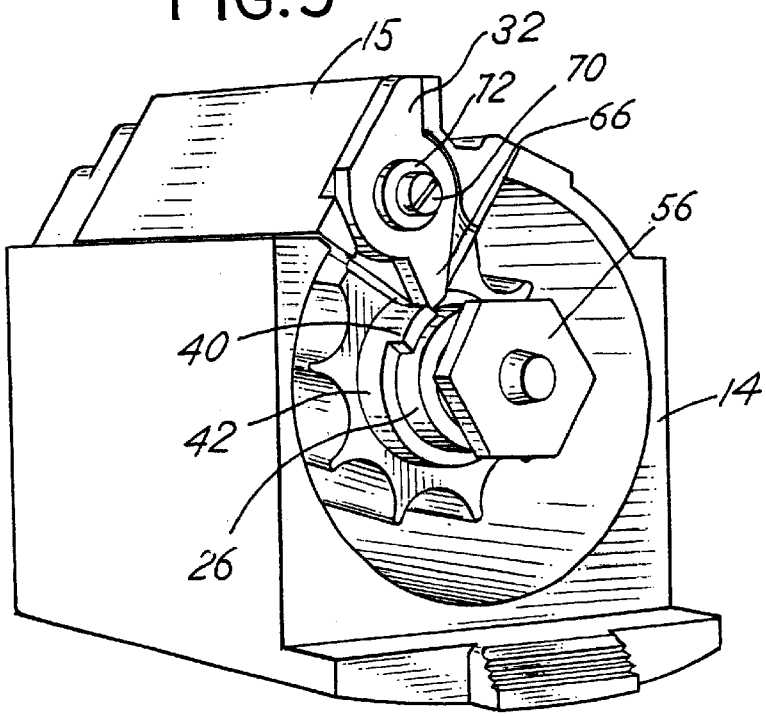
FIG. 9 is a perspective view of the magazine of FIG. 8, showing the hold-open lever and actuating trip stud in better detail.
Figure 10:
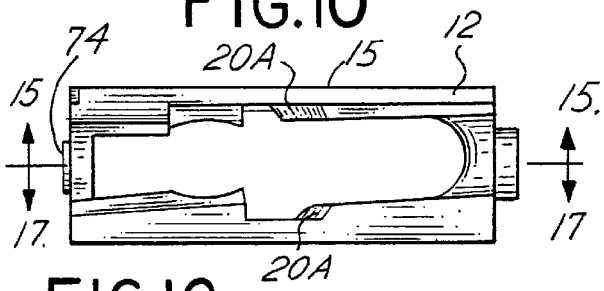
FIGS. 10–18 are a series of views of the feed insert for the magazine of FIG. 4, which has been modified from the factory feed insert in order to accommodate additional rotation of the magazine rotor after the last shot has been fired, such additional rotation allowing the trip stud of FIG. 9 to actuate the hold open lever and move the hold open lever into the position shown in FIG. 7.

A lever-actuating trip mechanism is carried by the shaft of the rotor that actuates or moves the lever from the rest position to the deployed position. Several different designs of a lever-actuating trip mechanism are described herein. However, they all share the same design feature by which they only engage the lever to move it to the second position when the rotor has rotated to a further rotational position after the last cartridge in the magazine has been fired. As shown in FIGS. 4A and 9, the trip mechanism takes the form of a stud 40 incorporated into a band 42 fastened to the shaft 26 of the rotor 16, as will be described in further detail below. Alternatively, the trip mechanism could take the form of a pin or a projection or other similar type of feature molded into the shaft of the rotor.

In order to accommodate this additional rotational movement of the rotor beyond the position provided by the factory model, the rotor and/or feed insert have to be formed so that the rotor 16 can rotate a sufficient amount past a nominal original position (rotor in position to receive the first cartridge) without interference between the rotor and the feed insert. The stock magazine can be modified by removing a portion of the material forming the rotor as described herein. Alternatively, a portion of the feed insert can be milled away to receive the portion of the rotor that would otherwise interfere with the feed insert. Alternatively, a combination of modifying both the rotor and the feed insert is possible, so as to provide the required additional rotation. Various embodiments are described below in which the rotor and/or feed insert are modified to provide void or recessed regions to avoid the interference at location 24 shown in FIGS. 1 and 2, and provide an additional ten or more degrees in rotation so that the trip mechanism actuates the hold-open lever to move it to the obstructing position shown in FIG. 7. This additional rotation is indicated in FIG. 6, where angle a indicates the additional rotation provided by the modification of the rotor and/or feed insert.

Referring now in particular to the exploded view of FIG. 4A, the structure of the magazine is described in further detail. The magazine housing 14 has an open interior region 52 for receiving the rotor 16 and cartridges (not shown). The rotor biasing spring 30 fits inside the rotor 16 and receives the shaft of the fastener 31. The spring 30 has a first end thereof 30A captured by an aperture 54 in the shaft 26 of the rotor, and a second end 30B which is captured by a small aperture 55 in a hex end cap 56. The spring 30 is wound approximately 1½ turns by manual rotation of hex end cap and then the hex end cap 56 is inserted into the hex opening 57 in a face or end plate 60 for the housing 14.

The trip band 42 having the hold-open lever actuating stud 40 is fastened to the shaft 26 of the rotor by means of a small pin 62, which secures the band 42 to the shaft 26 at the location of the hole 64. The location of the stud 40 is important, as its rotational position along the perimeter of the shaft 26 must be determined such that when the additional rotation provided by the modifications to the rotor or feed insert places the trip stud 40 in position for actuating the hold open lever 32. The stud 40 includes an edge 40A that contacts bottom portion of the hold-open lever 32.

As shown in FIG. 4A, the hold open lever 32 consists of a substantially flat and planar piece of hardened steel. The lever 32 includes a first portion 66 that depends downwardly and rides along the exterior surface of the shaft 26, immediately rearward of the band 42, as shown in FIG. 9, when the magazine is in an assembled condition. The lever 32, which is shown in a side view in FIG. 4C, includes a peripheral portion 32A that engages the bolt 50 of FIG. 4B to hold it open. The lever 32 is mounted to the side of the feed insert 12 at a lug 74 by means of a screw fastener 70 and washer 72. The aperture 78 of the lever 32 fits over the lug 74. Thus, the fastening of the lever 32 to the feed insert 12 is not tight; rather, the lever 32 is able to pivot about the lug 74. When the trip stud edge 40A engages the lower portion 66 of the lever 32, and in particular the projecting flange 66A of the hold-open lever (FIG. 4C), and the rotor 16 is further rotated an additional 10 or more degrees, the stud 40 causes the lever 32 to pivot about the axis of the stud 74. The portion 32A thus moves out of its aligned condition with the surface 15 of the feed insert 12 and into the path of the bolt, as shown in FIG. 7 and 4B.

Note that in FIG. 4A, the region 76 of the feed insert 16 is milled away from the factory or stock feed insert in the area of the lug 74 in order to accommodate the hold open lever 32 and allow it to rotate between the retracted and deployed positions.

Figure 8:
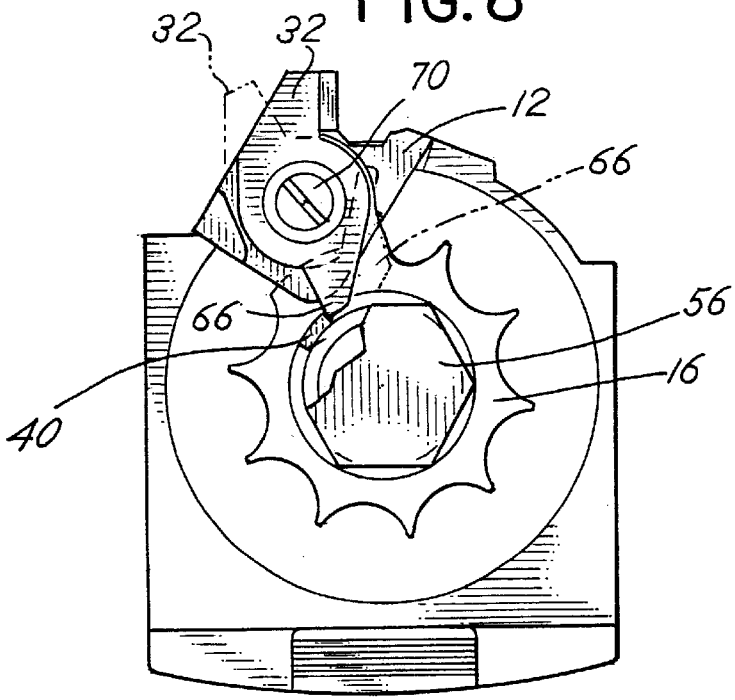
FIG. 8 is an end view of the magazine of FIG. 4 with the rear cover of the magazine housing removed.

FIG. 8 and FIG. 9 are two additional views of the assembled magazine, but with the end plate removed, showing the position of the trip mechanism 40 when the last cartridge is in position for firing. Note the aligned condition of the hold-open lever relative to the feed insert surface 15. When the last shot is fired and the rotor is allowed to rotate an additional 10–15 degrees, the lever 32 is actuated to the deployed position shown in dashed lines FIG. 8. The user then deploys the factory manual hold open device, on the rifle proper, then removes the magazine from the firearm and reloads it or replaces it. To reload it, a manual movement of the hold-open lever to its retracted position causes counter-rotation of the rotor 16, which eases the insertion of the first cartridge into the magazine.

Figure 1:
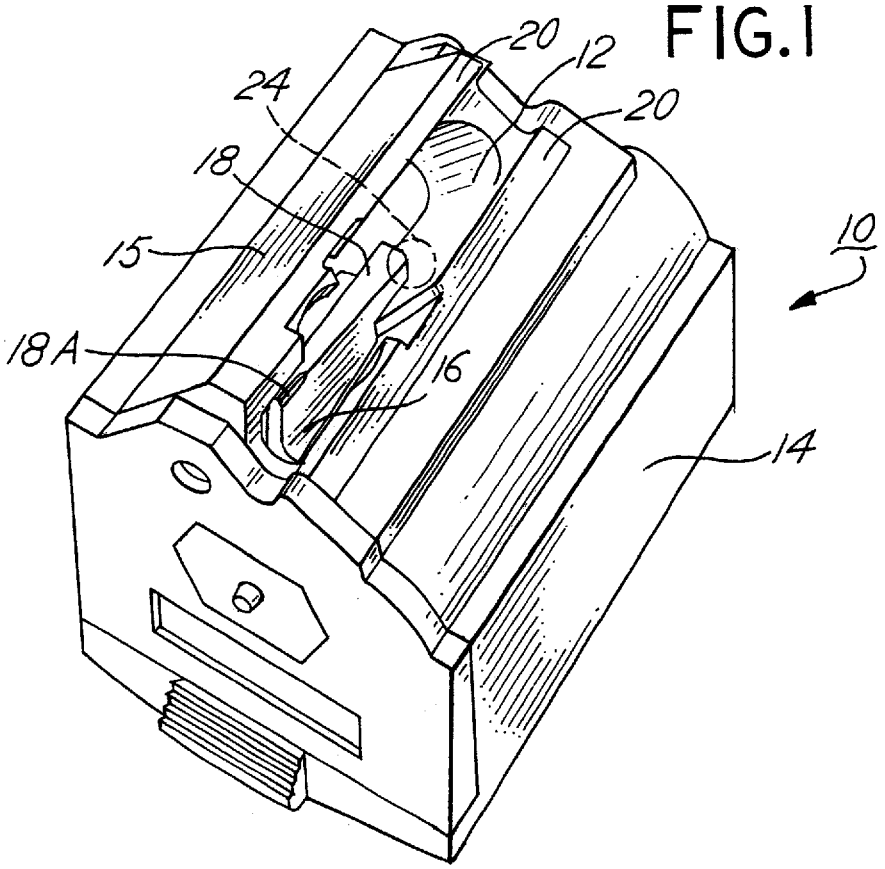
FIG. 1 is a perspective view of a stock, factory rotary magazine for Ruger® 10–22 caliber semi-automatic rifle, which does not have the hold open feature of the present invention.
Figure 2:
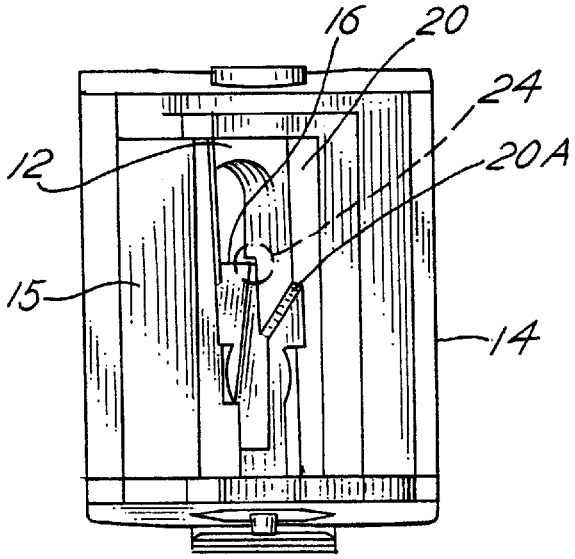
FIG. 2 is a top view of the factory magazine of FIG. 1.
Figure 3:
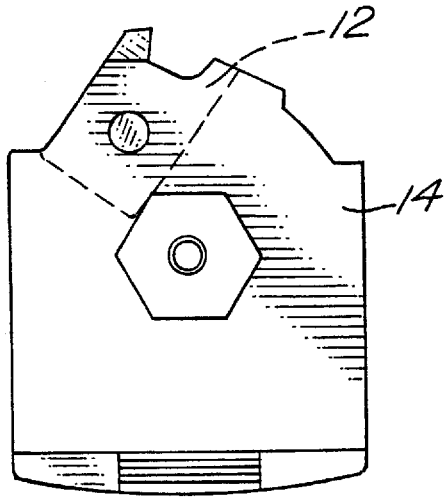
FIG. 3 is an end view of the factory magazine of FIG. 1, shown looking forward; the rotor of FIG. 1 rotates in a clockwise direction to discharge the cartridges when the magazine is viewed as shown in FIG. 3.
Figure 11:
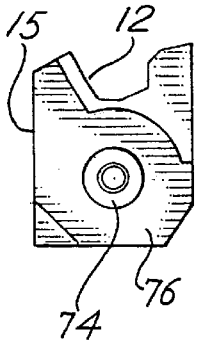
Figure 12:
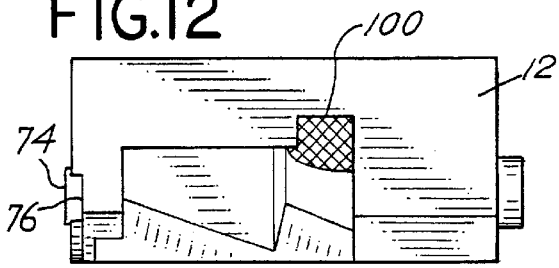
Figure 13:
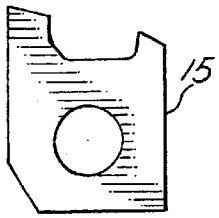
Figure 14:
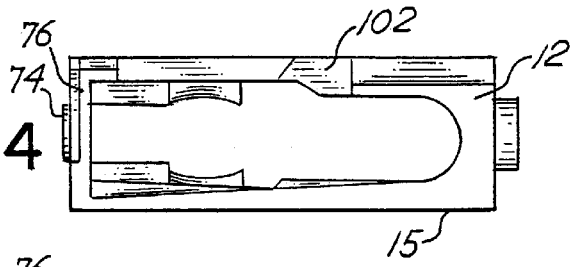
Figure 17:
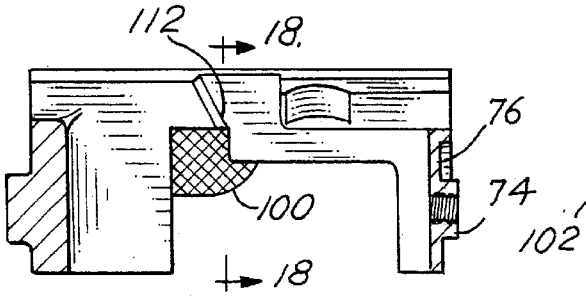
Figure 18:
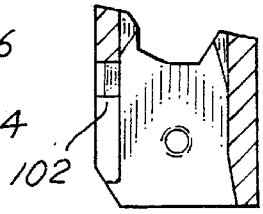

FIGS. 10–18 are a series of views of the feed insert 12 for the magazine of FIG. 4, which has been modified from the factory feed insert in order to accommodate additional rotation of the magazine rotor after the last shot has been fired. As noted in the discussion of FIG. 1, a binding between the rotor and feed insert occurs in the factory magazine at the location 24 shown in FIG. 1, and the goal of the modification of the feed insert and/or rotor is to eliminate this binding and allow the rotor to rotate an additional amount sufficient for the trip mechanism to actuate the hold-open lever. In FIG. 12, a molded stop projection or region 100 in the side of the feed insert shown in hatched lines is removed, leaving the notched outline as indicated. Thus, the interference at location 24 in FIG. 1 is eliminated and the ridge element 18 is allowed to further rotate relative to the feed insert without binding therebetween. Preferably, the modification to the feed insert leaves all the other surfaces critical to proper insertion and alignment of the cartridge relative to the feed insert intact, such as the feed lips 20A. The molded stop projection 100 removed from the feed insert is also shown in FIG. 18, with the tip of the rotor 18 of FIG. 4 allowed to move into the void region formed by the elimination of the portion 100, indicated at 102 in the cross section of FIG. 18 and the bottom view of FIG. 14.

Figure 15:
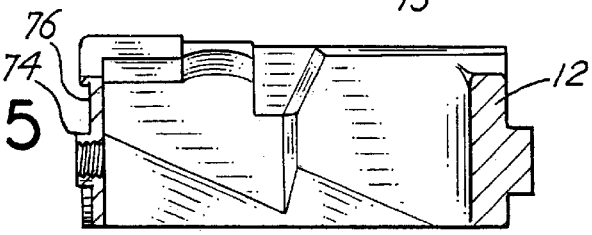
Figure 16:
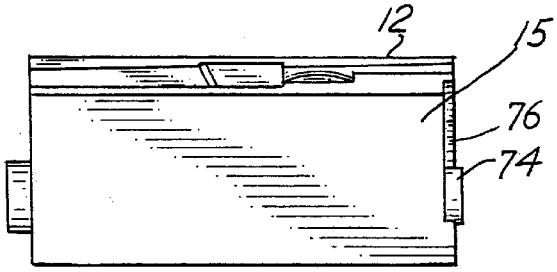

The end view of FIG. 11 shows clearly the surface 76 that is formed by milling the factory model to accommodate the hold-open lever therein. FIGS. 15 and 17 also show the lug 74 having internal threads to accommodate the screw 70 of FIG. 4A that fastens the hold-open lever to the lug 74.

In addition to the milling away of the portion 100 of the feed insert of FIGS. 12 and 18, the rotor itself is slightly modified to allow the additional rotation relative to the modified feed insert. FIGS. 25–28 show the factory rotor 16. FIGS. 29–32 show the modification made. The modification consists of a removing of a portion of the side of the ridge element 18, indicated at 104. This removal of the portion of the ridge element is again made to allow the rotor to rotate relative to the feed insert beyond the nominal original position to allow the trip mechanism to actuate the hold open lever. The degree and location of the removal of material from the ridge element, indicated at 104, will be dictated by the modifications, if any, to the feed insert, the location of such modifications, and the desired amount of additional rotation. The modification shown in FIGS. 29–32 works with the modified feed insert of FIGS. 10–18.

Figure 19:
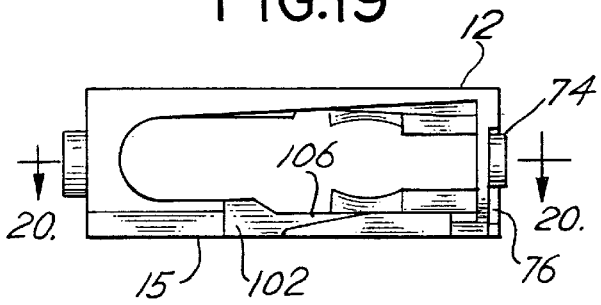
FIGS. 19–21 are a series of views of an alternative embodiment of the feed insert of FIGS. 10–18, the feed insert again having features designed to allow the factory magazine rotor of FIGS. 25–28 to rotate an additional amount after the last shot has been fired to cause actuation of the hold-open lever.
Figure 20:
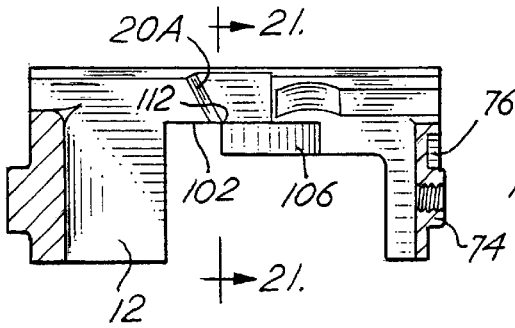
Figure 21:
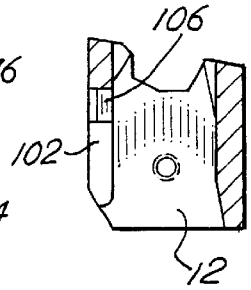

A second embodiment of the modified feed insert is shown in FIGS. 19–21. The modification consists of removing the molded stop projection portion 100 of FIG. 12 and cutting the right-hand side of the feed insert on an angle to allow the rotor to rotate the additional amount, resulting in the void region 102 and the slanted wall portion 106 shown in FIGS. 19–21. In the embodiment of FIGS. 19–21, the rotor is not altered at all (no dishing out as shown in FIGS. 29–32, and the factory ridge 18 configuration can be used). The peripheral portion 110 of the ridge element 18 (FIG. 25) fits into the void region 102 of the feed insert of FIG. 19–21 and region adjacent to the slanted wall portion 106, and thereby allows the rotor to rotate approximately 14 degrees more than provided in the factory magazine. FIG. 20 shows that the cartridge feed ramp 20A formed in the side of the feed insert is altered in this embodiment.

Figure 22:
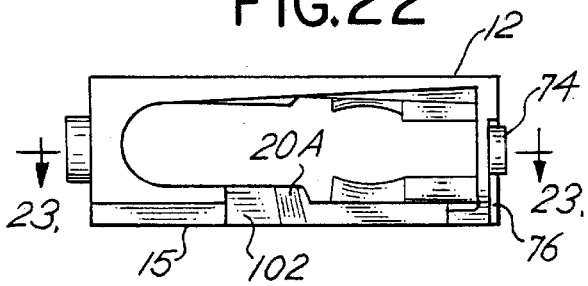
FIGS. 22–24 are a series of views of a preferred alternative to the feed insert of FIGS. 10–18.
Figure 23:
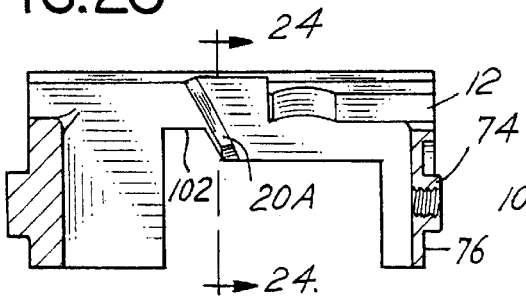
Figure 24:
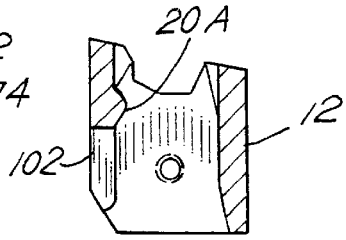
Figure 25:
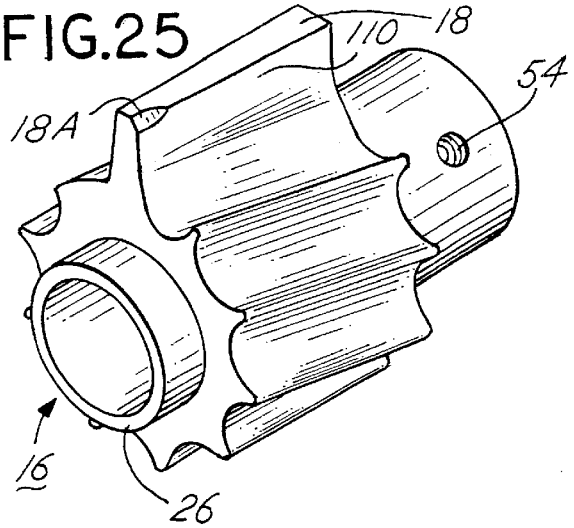
FIGS. 25–28 are a series of views of a factory magazine rotor.
Figure 26:
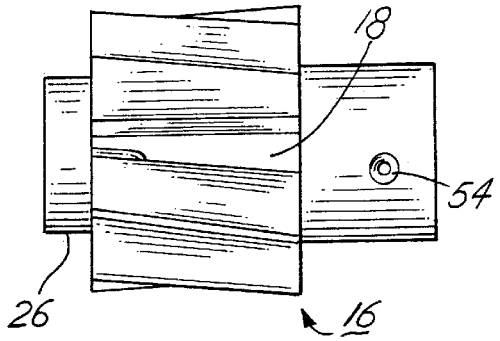
Figure 27:
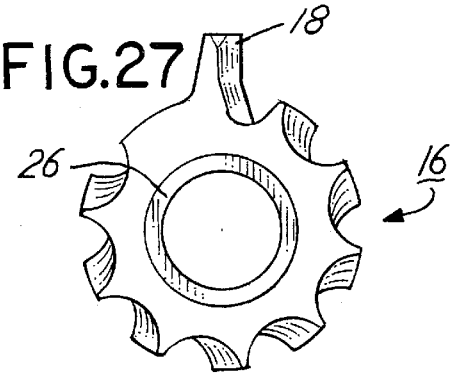
Figure 28:
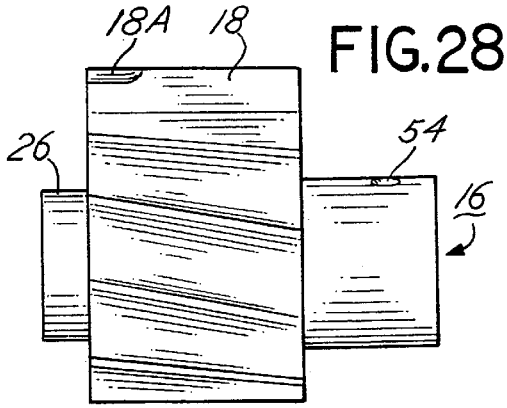
Figure 29:
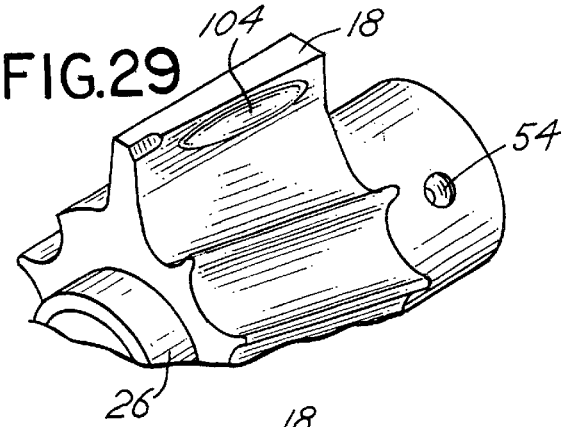
FIGS. 29–32 are a series of views of an alternative embodiment of the magazine rotor of FIGS. 25–28, designed to work with the embodiment of the feed insert shown in FIGS. 10–18.
Figure 30:
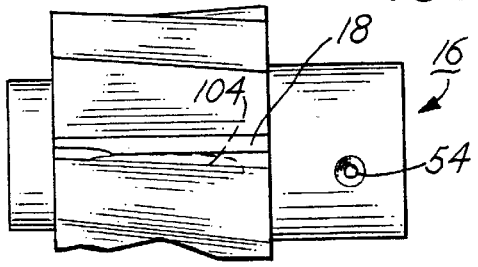
Figure 31:
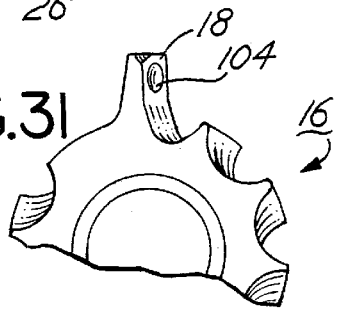
Figure 32:
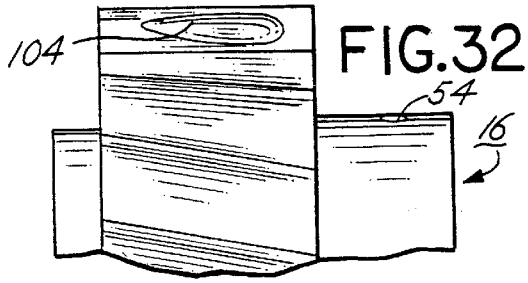
Figure 33:
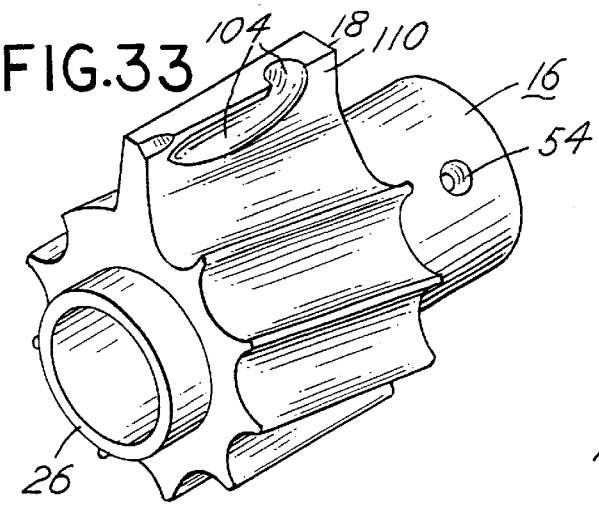
FIGS. 33–36 are a series of views of the preferred alternative to the magazine rotor of FIGS. 25–28, designed to work with the embodiment of the feed insert shown in FIGS. 22–24.
Figure 34:
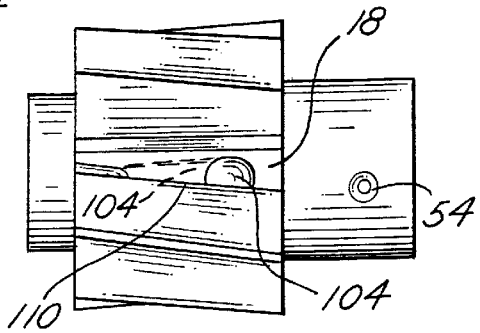
Figure 35:
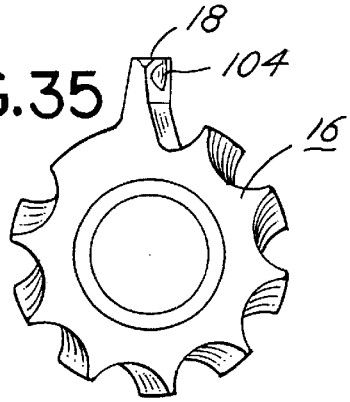

FIGS. 22–24 show a preferred embodiment of a modified feed insert. In this embodiment, the stop projection 100 of FIG. 12 is machined away, but the cartridge feed ramp 20A is left intact. The advantage of this embodiment relative to the embodiment of FIGS. 19–21 is that the feed ramp is left completely unaltered, thereby helping to insure that the cartridges are aligned properly with respect to the feed insert as cartridges are moved into the firing position. As such, the embodiment of FIGS. 22–24 is preferred. However, since the feed ramp 20A is left unaltered, the factory rotor must be modified to allow the ridge element 18 to further rotate relative to the feed insert without binding. The required modifications to the rotor are shown in FIGS. 33–36. In particular, the surface 110 of the ridge element 18 is modified by removing material as indicated at 104.

It is also possible to leave the factory insert intact and just modify the rotor 16 to provide for the desired additional rotation without interference between the rotor and feed insert. FIGS. 37–40 show such a modified rotor. The advantage of this embodiment is again that the feed ramps of the feed insert do not have to be modified in any way. In the embodiment of FIGS. 37–40, the rotor surface 110 is modified by removing material as indicated at 104. However, in this embodiment, the pronounced removal of material from the rotor's ridge element 18 can cause occasional jamming of the last cartridge when the magazine is fully loaded, due to the last round tipping into the dished out portion 104 of FIG. 37.

Of the various embodiments described above, the feed insert embodiment of FIGS. 22–24 along with the rotor embodiment of FIGS. 33–36 was found to be the preferred method for providing the additional rotation because it does not alter the original factory cartridge feed ramp 20A configuration and the cartridges feed and discharge relative to the feed insert with 100 percent reliability. In the embodiments of FIGS. 17 and 20, it was found that the bottom corner of the right-hand feed ramp 20A needed to be rounded slightly, as indicated at 112, to feed properly with 100 percent reliability.

In all of the embodiments of FIGS. 10–24, the end of the feed insert 12 is machined to accommodate the hold-open lever, as indicated at 76 in FIGS. 4A, 11–15, 19 and 22. Additionally, the lug 74 is modified by shortening it slightly, and drilling and tapping it for screw threads to accommodate the screw 70 of FIG. 4A. The hold open lever also works without the screw and washer of FIG. 4A, and thus these components are not required. As yet another alternative, the hold-open lever could be retained against the stud 74 by means of an E-clip placed around the stud 74 immediate rearward of the hold-open lever. As another alternative, the hold open lever could freely float on an original, factory length stud 74, and allow the machined out portion 118 of the rear end plate 60 of the magazine (FIG. 41) to sandwich the hold-open lever between itself and the rear machined area 76 of the feed insert.

The hold open lever 32 itself is preferably made from tool steel that has been hardened to withstand the hold-open forces. Tool steel hardened to a straw temper, or mild steel that has been case hardened are two possibilities. The hold open lever in one embodiment is given the configuration and shape shown in FIGS. 4A, 4C, 8 and 9.

Figure 41:
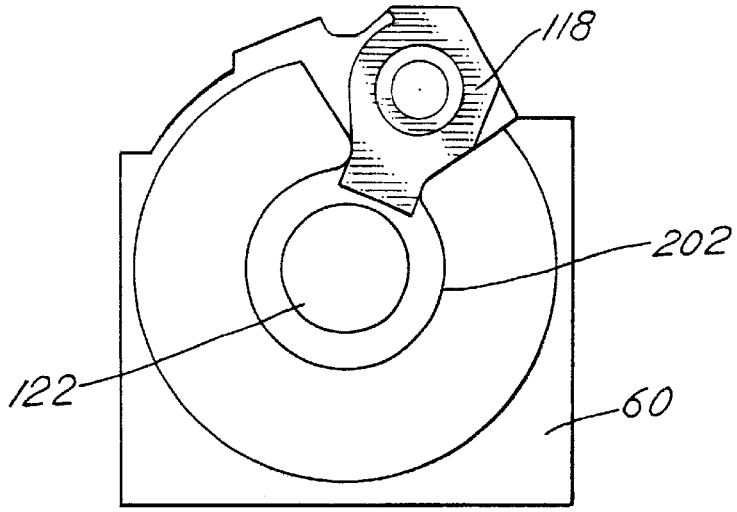
FIG. 41 is an end view of the cover plate of the magazine housing, showing the area milled away in order to accommodate the hold-open lever.

The interior surface rear plastic end plate 60 of FIG. 4A is machined out to accommodate the hold-open lever, as shown in FIG. 41. In particular, the area 118 is machined out to accommodate the hold-open lever flush against the rear of the feed insert. Of course, the end plate could be molded in a fashion such that the additional gap provided by the machining shown in FIG. 41 is molded into the end plate 60.

Figure 36:
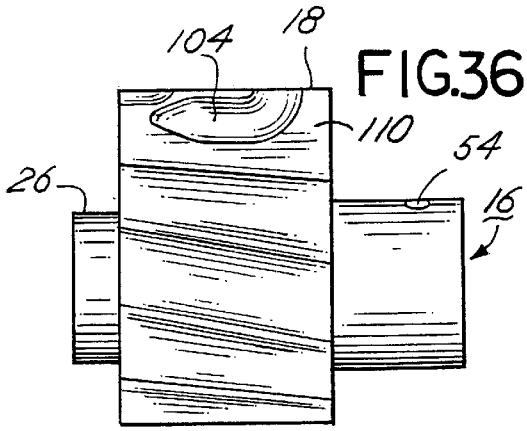
Figure 37:
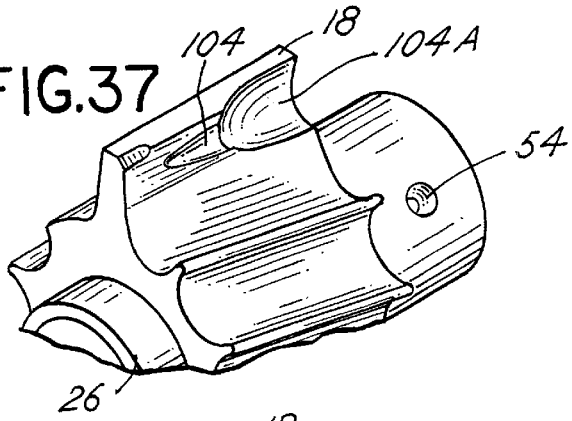
FIGS. 37–40 are a series of views of yet another embodiment of the modified magazine rotor designed to work with a factory feed insert.
Figure 38:
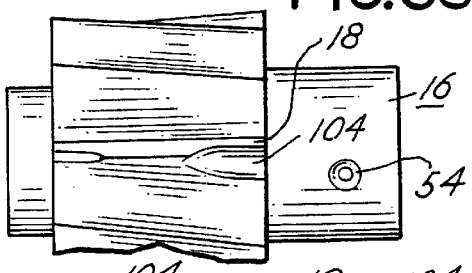
Figure 39:
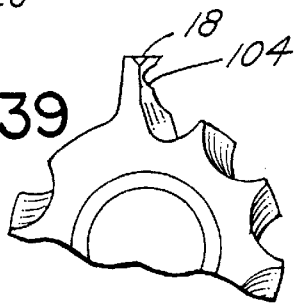
Figure 40:
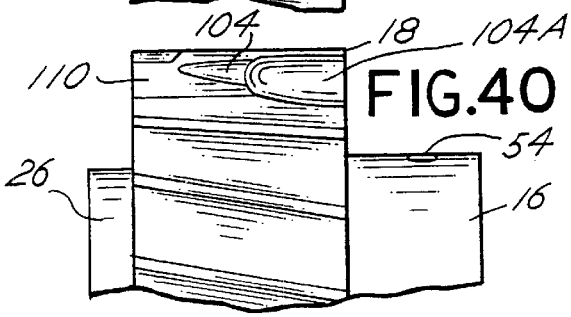

Referring to FIGS. 4A and 36, the diameter of the shaft 26 of the rotor 16 is reduced slightly from the factory diameter to accommodate the trip band 42. The outside diameter and length of the trip band 42 is the same as the factory rotor shaft area 26, thus it fits flush with the end plate 60 of FIG. 41 and no modification is needed to the peripheral rim 202 (at least for the embodiments described thus far). The trip band 42 is fastened to the shaft of the rotor by means of a small screw or pin 62 as shown in FIG. 4A. An alternative trip mechanism consists of a steel pin or screw installed in the shaft 26 of the rotor in the location of the trip stud 40 as shown in FIGS. 8 and 9. As noted earlier, yet another embodiment of the trip mechanism would be a molded projection or other feature on the shaft of the rotor that would engage the portion 66 of the hold-open lever when the additional rotation of the rotor is performed. The lower portion 66 of the hold-open lever rides on the surface of the rotor shaft 26 to hold it in place until the last round is out of the magazine, at which time the trip stud contacts the lower portion 66A (FIG. 4C) of the hold-open lever.

The operation of the magazine is as follows. With reference to FIGS. 4B, 8, 9, 43, 44 and 45, when the last cartridge is fed into the chamber of the rifle and fired, the rifle bolt recoils to its rearmost position. The hold-open lever 32 is free to rotate to the left into the position shown in FIG. 7 due to the additional rotation of the rotor relative to the feed insert and actuation of the hold open lever by the trip mechanism. In particular, the trip stud 40 (and particularly contact edge 40A) contacts the portion 66A of the hold-open lever and the spring 30 forces the rotor in a further clockwise rotation (as seen from the rear). This causes the hold-open lever to move to the deployed position, blocking the bolt from going forward into the battery (closed position) signaling that the firearm is out of ammunition. Prior to discharge of the last round, the hold-open lever is held in the rest or non-deployed position by the rim of the cartridge bearing on the portion 18A of the ridge element 18 (FIG. 1), preventing rotation of the rotor past its nominal original position.

The magazine is easily loaded by pushing the hold-open lever to the closed position with a finger of one hand, while inserting the first cartridge into the feed insert with the other hand. Thereafter, the remaining rounds are inserted in standard fashion.

Figure 46:
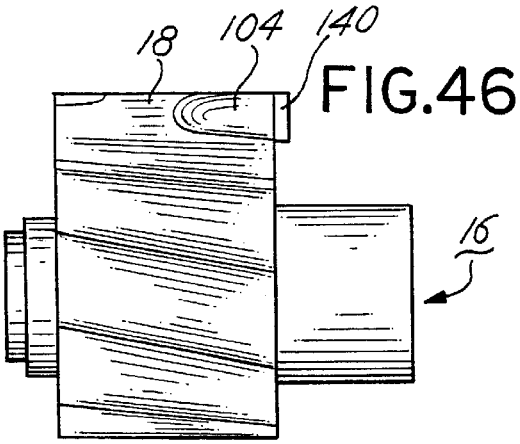
FIG. 46 is an elevational view of yet another alternative embodiment of the rotor.
Figure 45:
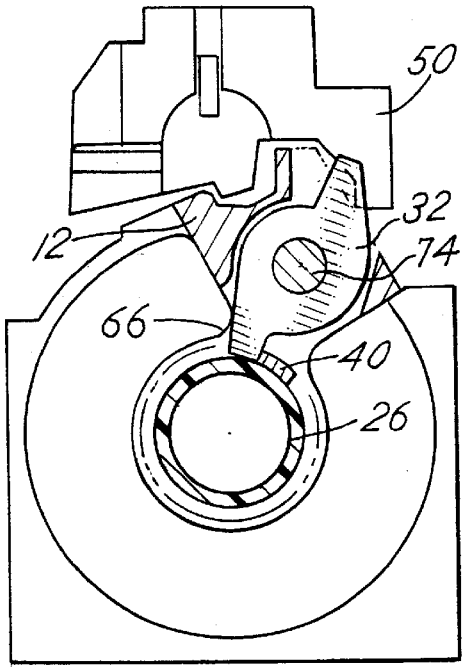
FIG. 45 is a front view, partially in cross-section, of the magazine of FIG. 4 showing the hold-open lever interfering with the forward movement of the rifle bolt after the last shot has been fired.
Figure 47:
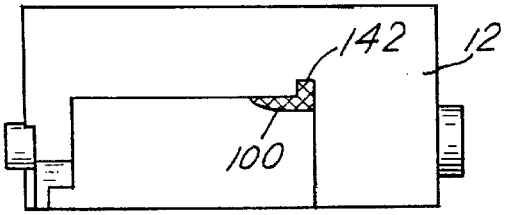
FIG. 47 is a side view of a feed insert designed to accommodate the rotor of FIG. 46.

Referring to FIG. 46, the method of removing material from the rotor shown in FIGS. 37–40 could be used if the rotor were lengthened slightly at 140, FIG. 46, to keep its front edge intact. A slight cut is machined in the feed insert ahead of the molded stop lip at 142, FIG. 47. The modified rotor 16 is shown in FIG. 46, showing dished out portion 104 and lengthened portion 140 of ridge element 18. The modified feed insert 12 is shown in FIG. 47, showing the slot 142 cut out to accommodate the lengthened portion 140.

Several other designs of hold-open levers and retaining clips for the levers are contemplated, and will be discussed now in conjunction with FIGS. 48–68. The embodiments of these figures are designed to provide linear movement of the hold open lever, and provide more of a bearing surface for contacting the rifle bolt. They also provide for means for retaining the hold-open lever in the lower or retracted position until actuation by the trip mechanism.

Figure 49:
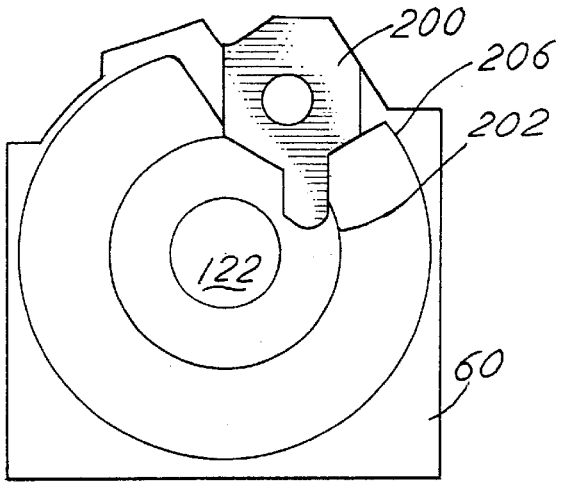
FIG. 49 is an elevational view of the inside of the end plate for the magazine housing for another alternative embodiment of the hold open lever of FIG. 4.
Figure 48:
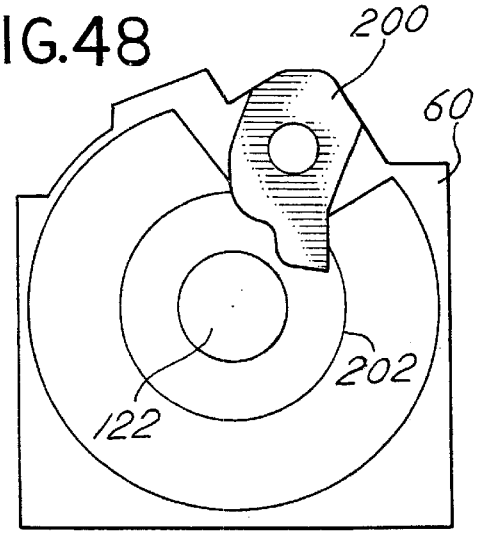
FIG. 48 is an elevational view of the inside of the end plate for the magazine housing for an alternative embodiment of the hold open lever of FIG. 4.

Referring to FIG. 48, the end plate 60 has a region 200 routed out (or a recess formed in the first instance when the part is molded) to accommodate the alternate design hold open lever. The alternate hold open lever for this embodiment is shown in FIG. 59 and will be described subsequently. This alternative design uses a modified trip band 42 and trip stud (FIGS. 56A and 56B). The circular edge 202 is enlarged to accommodate the trip band 42 and provide clearance for the trip stud 40. FIG. 49 shows a modified end plate 60 which is designed to work with the alternative hold-open lever of FIGS. 50 and 51. The end plate 60 of FIG. 49 has an increased diameter for the circular edge 202.

The inside diameter of the edge 202 could remain per the factory model, if the trip stud and portion 66 of the hold open lever (FIGS. 57, 61) are modified to be more towards the center of the magazine. The enlargement indicated at 202 in FIGS. 48 and 49 permits more of a straight line movement at the contact point of the trip stud 40 and the portion 66 of the hold open lever.

Figures 50A, 50B:
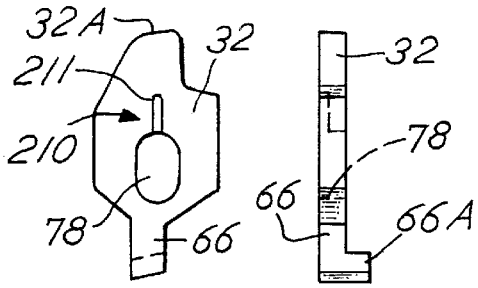
FIGS. 50A and 50B are two views of an alternative embodiment of the hold open lever of FIG. 4.
Figure 52:
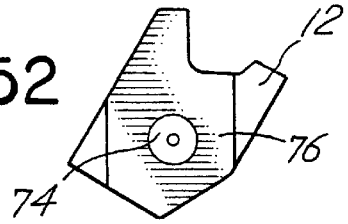
FIG. 52 is an end view of the feed insert of FIG. 4 showing the portion milled away to make room for the hold open lever of FIGS. 50 and 51 to reciprocate in a linear fashion.
Figures 51A, 51B:
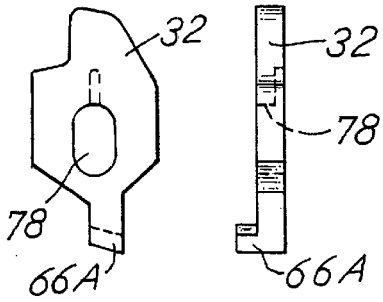
FIGS. 51A and 51B are two additional views of the hold open lever of FIGS. 50A and 50B.
Figure 53A:
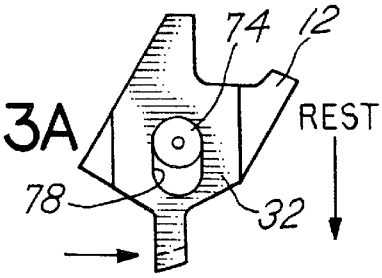
FIGS. 53A and 53B show rest and deployed positions, respectively, of the hold open lever of FIGS. 50 and 51 relative to the feed insert of FIGS. 4 and 52.
Figure 53B:
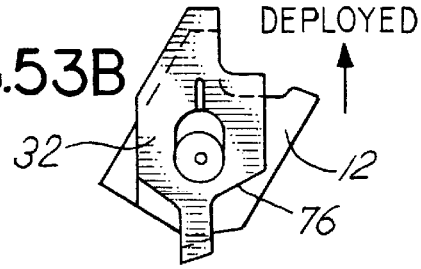

The hold open lever 32 of FIGS. 50 and 51 includes a flat planar body having a lower portion 66 with trip stud contact flange 66A, and upper portion 32A which contacts the rifle bolt, and a central aperture 78 in the form of a slot to allow vertical, linear movement of the hold-open lever relative to the feed insert. The lever 32 includes a small groove 210 which is designed to retain a projecting tit 212 on a spring retainer clip 214 shown in FIGS. 54A and 54B. The slotted central aperture 78 is provided to allow the hold-open lever to move in a linear fashion vertically upwards when the trip stud 40 of FIG. 56A contacts the portion 66A of the hold-open lever. The feed insert 12 is modified by providing a machined away area 76 shown in FIG. 52 to accommodate the hold open lever of FIGS. 50 and 51. FIG. 53A shows the hold-open lever in the lower or rest position, FIG. 53B shows the hold open lever moved to the deployed position. FIGS. 54A and 54B show the flat metal spring retainer 214 that fits over the hold-open lever and is retained securely against the hold open lever. The retainer 214 has a hole 216 for receiving the screw 70 of FIG. 4A. The retainer is mounted to the hold-open lever with the tit 212 fitting into the groove 210. FIG. 55 shows the assembly of the retainer 214 and the hold-open lever. FIG. 57 shows the assembly of the rotor, feed insert, hold-open lever 32, but with the retainer 214 and screw 70 removed to better illustrate the slotted central aperture 78 of the hold-open lever relative to the stud 74. The corner 222 of the feed insert is milled slightly to allow for the extra diameter of the trip stud 40 (FIG. 56A) during rotational movement thereof.

The purpose of the spring clip 214 is to retain the hold open lever in the lower, non-deployed condition prior to the firing of the last cartridge in the magazine. When the magazine is loaded with cartridges, the user manually depresses the hold-open lever 32 of FIG. 57. This action causes the tit 212 to ride along the slot 210 until it seats in a detent 211 in the hold-open lever. The engagement of the tit 212 in the detent 211 secures the hold-open lever in the lower position. As with the other embodiments, the rotation of the rotor after the last cartridge is fired and associated rotation of the trip stud 40 results in contact between the stud 40 and the portion 66A of the hold-open lever as shown in FIG. 57, forcing the lever 32 vertically upwards into the path of the rifle bolt and holding it open.

FIG. 59 shows an alternative configuration of the hold-open lever 32. In this embodiment, the hold-open lever includes a slight slot 224 which receives a bent lip feature 226 (shown in FIGS. 60A and 60B) of a spring clip 230 designed to hold the hold-open lever in the lower, non-deployed position prior to firing of the last cartridge. The end of the feed insert 12 is machined away to accommodate the hold open lever, as indicated in FIG. 58 at 76. The spring clip 230 includes a central hole for receiving the screw 70 (FIG. 4A) allowing the spring clip to be fastened to the feed insert and securing the hold open lever to the feed insert. The hold-open lever of FIG. 59 also includes a central aperture 78 shaped to allow for vertical, linear movement relative to the stud 74 of the feed insert. FIG. 61 shows the assembly with the hold-open lever 32 in the deployed position. Portion 32A is in the path of the rifle bolt. FIG. 62A shows just the spring clip, hold-open lever and feed insert in the lower, non-deployed position; FIG. 62B shows the components in the deployed position.

The embodiment of FIGS. 59 and 62 works as follows. The user manually depresses the hold-open lever when they are loading the first cartridge into the magazine. As the hold-open lever moves vertically downward, the bent lip 226 of the spring clip 230 snaps into the slot 224 in the lever 32, retaining the lever in the lower, non-deployed position. When the last cartridge is fired, the rotation of the rotor causes the trip stud 40 of FIG. 56 to engage the portion 66A of the hold open lever, moving it vertically upwards, releasing the clip 230 from the slot 224, and forcing the peripheral portion of the lever into the path of the rifle bolt holding it open.

FIGS. 63 and 64 shows an embodiment in which a ball bearing 240 rides along the surface 76 of the feed insert within a hole 242 provided in the hold open lever. A spring clip 244 has a small hole or detent 246, smaller than the diameter of the ball bearing, to capture a portion of the ball bearing when the hold open lever is manually moved to the lower position. The spring clip is shown isolated in FIG. 67. This construction again helps the hold-open lever remain in the lower position prior to discharge of the last round in the magazine. As shown in FIG. 65, the detent for capturing the ball bearing could be provided in the washer 72 for a hold-open lever of the design of FIG. 4A. In this embodiment, the extreme lowermost portion 66 of the hold-open lever does not need to ride on the surface of the shaft of the rotor to keep the hold-open lever from rotating to the deployed position prematurely. Alternatively, the hold-open lever of the design of FIG. 4A could have its own spring clip of the type shown in FIG. 67, as shown in FIG. 68.

FIG. 66 illustrates an embodiment in which a spring 250 and plunger 252 are placed in the sidewall of the end plate 60. The tip of the plunger bears against the lower portion of the hold open lever to prevent it from moving into the deployed position prematurely. The embodiment of FIG. 66 is rather difficult to assemble and therefore is less preferred.

Numerous embodiments of the invention have been set forth above. Persons skilled in the art will appreciate that variations and modifications from the illustrated embodiments may be made without departure from the scope of the invention. Such variations may be dictated in view of manufacturing or assembly considerations, for example. The reader is directed to the appended claims for the true scope of the invention, which is intended to encompass all such modifications and alternative configurations.

What is claimed is:

1. A rotary magazine for use with a firearm having a reciprocating bolt, said bolt reciprocating between a open position and a closed, firing position, the rotary magazine comprising:

a magazine housing adapted for containing a plurality of cartridges;

a feed insert carried by said housing having a surface along which said bolt travels when reciprocating between said closed and open positions;

a rotor contained within said housing having a shaft rotating about an axis, said rotor advancing cartridges one by one to a firing position in said magazine;

a hold-open lever positioned within said magazine having a first position and a second position in which said lever is in a non-aligned condition relative to said feed insert, said lever in said second position blocking movement of said bolt from said open position to said closed position; and trip means carried by said shaft of said rotor actuating said lever from said first position to said second position when said rotor has rotated to a further rotational position after the last cartridge in said magazine has been fired.

2. The rotary magazine of claim 1, wherein said rotary magazine comprises a rotary magazine for a semi-automatic firearm.

3. The rotary magazine of claim 2, wherein said semi-automatic firearm comprises a semi-automatic rifle.

4. The rotary magazine of claim 1, wherein said feed insert further comprises a void or recessed region of predetermined configuration adapted for receiving a portion of said rotor to thereby prevent interference between said rotor and said feed insert and allow (1) said rotor to rotate further in a feed direction after the last cartridge in said magazine has been fired and said rotor has rotated to a nominal original position, and (2) said trip means to actuate said lever and move said lever from said first position to said second position.

5. The rotary magazine of claim 1, wherein said rotor further comprises a recessed region of predetermined configuration adapted for receiving therein a portion of said feed insert to thereby prevent interference between said rotor and said feed insert and allow (1) said rotor to further rotate in a feed direction after the last cartridge in said magazine has fired and said rotor has rotated to a nominal original position, and (2) said trip means to actuate said lever and move said lever from said first position to said second position.

6. The rotary magazine of claim 1, wherein said trip means comprises a pin.

7. The rotary magazine of claim 1, wherein said trip means comprises a projection molded into said rotor.

8. The rotary magazine of claim 1, wherein said trip means comprises a band placed around said shaft, said band further comprising a stud for contacting said hold open lever.

9. The rotary magazine of claim 1, wherein said hold open lever comprises a substantially flat planar body having a first projecting portion abutting against said bolt to block forward motion of said bolt, a second projecting portion, and a central aperture for receiving a fastener fastening said hold open lever to said feed insert, said trip means mounted to said rotor such that said trip means contacts said second projecting portion causing said hold open lever to pivot about an axis defined by said fastener to thereby place said first projecting portion in position to block said forward motion of said bolt.

10. The rotary magazine of claim 1, wherein said rotor and feed insert are configured to permit at least 10 degrees of additional rotation in said rotor after the last cartridge in said magazine has been fired and said rotor has moved to a nominal original position, said trip means engaging said lever as said rotor rotates said at least 10 degrees to thereby cause said lever to move to said second position to block forward motion of said bolt.

11. The rotary magazine of claim 1, wherein said hold open lever comprises a substantially flat planar body having a first projecting portion for abutting against said bolt to block forward motion of said bolt, and a second projecting portion, said hold open lever sandwiched between said feed insert and a rear cover for said housing; said trip means mounted to said rotor such that said trip means contacts said second projecting portion causing said hold open lever to move relative to said feed insert to thereby place said first projecting portion in position to block said forward motion of said bolt.

12. The magazine of claim 1, further comprising a spring clip for retaining said hold-open lever in said first position.

13. The magazine of claim 1, wherein said hold-open lever and feed insert are configured such that said hold-open lever moves in a linear fashion relative to said feed insert between said first and second positions.

14. The magazine of claim 1, further comprising a ball bearing surrounded by said hold open lever riding over said feed insert.

15. The magazine of claim 14, wherein said ball bearing is captured by a spring clip.

16. In a rotary magazine for use with a firearm having a bolt, the rotary magazine comprising a rotor, a feed insert, and a housing for containing a plurality of cartridges and receiving said rotor and feed insert, the improvement comprising:

providing a hold open lever in said magazine;

providing a trip mechanism on said rotor for actuating said hold open lever; and forming said rotor and feed insert such that rotor may freely rotate relative to said feed insert without interference therebetween a sufficient amount after the last cartridge has been fired from said magazine and said rotor has rotated to a nominal original position, wherein said sufficient amount of rotation of said rotor relative to said feed insert after the last cartridge has been fired is sufficient to allow said trip mechanism to actuate said hold-open lever to move a portion of said hold open lever into the path of said bolt, thereby holding open said bolt after the last cartridge in said magazine has been fired and said bolt has recoiled to an open position.

17. The improvement of claim 16, wherein said rotary magazine comprises a rotary magazine for a semi-automatic firearm.

18. The improvement of claim 17, wherein said semi-automatic firearm comprises a semi-automatic rifle.

19. The improvement of claim 16, wherein said feed insert further comprises a void or recessed region of predetermined configuration adapter for receiving a portion of said rotor to thereby prevent interference between said rotor and said feed insert and allow (1) said rotor to rotate further in a feed direction after the last cartridge in said magazine has been fired and said rotor has rotated to said nominal original position, and (2) said trip mechanism to actuate said lever and move said portion of said lever into the path of said bolt.

20. The improvement of claim 16, wherein said rotor further comprises a recessed region of predetermined configuration adapted for receiving therein a portion of said feed insert to thereby prevent interference between said rotor and said feed insert and allow (1) said rotor to further rotate in a feed direction after the last cartridge in said magazine has been fired and said rotor has rotated to said nominal original position, and (2) said trip mechanism to actuate said lever and move said portion of said lever into the path of said bolt.

21. The improvement of claim 16, wherein said trip mechanism comprises a pin affixed to said rotor.

22. The improvement of claim 16, where said trip mechanism comprises a projection molded into said rotor.

23. The improvement of claim 16, wherein said trip mechanism comprises a band placed around a shaft of said rotor, said band further comprising a stud for contacting said hold-open lever.

24. The improvement of claim 16, wherein said hold open lever comprises a substantially flat planar body having a first projecting portion for abutting against said bolt to block forward motion of said bolt, a second projecting portion, and a central aperture for receiving a fastener fastening said lever to said feed insert, said trip mechanism mounted to said rotor such that said trip mechanism contacts said second projecting portion causing said lever to pivot about said fastener to thereby place said first projecting portion in position to block said forward motion of said bolt.

25. The improvement of claim 16, wherein said rotor and feed insert are configured to permit at least 10 degrees of additional rotation in said rotor after the last cartridge in said magazine has been fired and said rotor has moved to said nominal original position, said trip mechanism engaging said lever as said rotor rotates said at least 10 degrees to thereby cause said lever to move to said position to block forward motion of said bolt.

26. The improvement of claim 16, wherein said hold open lever comprises a substantially flat planar body having a first projecting portion for abutting against said bolt to block forward motion of said bolt, and a second projecting portion, said hold open lever sandwiched between said feed insert and a rear cover for said housing; said trip mechanism mounted to said rotor such that said trip mechanism contacts said second projecting portion causing said hold open lever to move relative to said feed insert to thereby place said first projecting portion in position to block said forward motion of said bolt.

27. The improvement of claim 16, wherein said hold open lever is mounted to said feed insert, and wherein said feed insert further comprises a void portion to accommodate said hold open lever.

* * * * *